US011813506B2

(12) United States Patent
Kawaguchi et al.

(10) Patent No.: US 11,813,506 B2
(45) Date of Patent: Nov. 14, 2023

(54) GOLF CLUB DAMPING

(71) Applicant: Acushnet Company, Fairhaven, MA (US)

(72) Inventors: Hiroshi Kawaguchi, Aliso Viejo, CA (US); Ryan J. A. Ritchie, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 231 days.

(21) Appl. No.: 17/460,072

(22) Filed: Aug. 27, 2021

(65) Prior Publication Data

US 2023/0065680 A1 Mar. 2, 2023

(51) Int. Cl.
*A63B 53/04* (2015.01)
*A63B 60/54* (2015.01)

(52) U.S. Cl.
CPC ..... *A63B 53/0475* (2013.01); *A63B 53/0408* (2020.08); *A63B 60/54* (2015.10); *A63B 2209/00* (2013.01)

(58) Field of Classification Search
CPC . A63B 53/0475; A63B 60/54; A63B 53/0408; A63B 2209/00
USPC ..... 473/332, 347, 348
See application file for complete search history.

(56) References Cited

U.S. PATENT DOCUMENTS 1,133,129 A 3/1915 Govan
2,007,377 A * 7/1935 Link ..... A63B 53/047 473/350
2,111,249 A 3/1938 Plese
3,817,522 A 6/1974 Simmons
4,195,842 A 4/1980 Coleman
4,398,965 A 8/1983 Campau
4,412,864 A * 11/1983 Kurashige ..... C08L 15/00 524/76
4,754,977 A 7/1988 Sahm
(Continued)

FOREIGN PATENT DOCUMENTS

JP 03007178 A 1/1991
JP H11-192329 5/2001
(Continued)

OTHER PUBLICATIONS

Translation of FR-2695934-A3; Inventor Hans Erne et al; "Composite Moulded Resin Construction Elements—With Synthetic Resin Binder and Metallic Filler", see pp. 1-10; Translation dated 2023. (Year: 2023).*

*Primary Examiner* — Sebastiano Passaniti
(74) *Attorney, Agent, or Firm* — Mike S. Kim

(57) ABSTRACT

A golf club head including a striking face including a front surface configured to strike a golf ball and a rear surface opposite the front surface, a damping element abutting the rear surface of the striking face, wherein the damping element comprises a binder and a filler, wherein the filler has a density less than or equal to 2 g/cc and the binder has a density greater than or equal to 3 g/cc and less than or equal to 12 g/cc, wherein the filler is substantially evenly distributed throughout the binder, wherein the filler comprises a plurality of particles, wherein the particles of the filler are less than 5.0 mm in diameter, and wherein the damping element comprises an average thickness, wherein the average thickness of the damping element is greater than or equal to 5 μm and less than or equal to 100 μm.

20 Claims, 7 Drawing Sheets

(56) References Cited

U.S. PATENT DOCUMENTS 4,811,950 A 3/1989 Kobayashi
4,826,172 A 5/1989 Antonious
4,928,972 A 5/1990 Nakanishi
4,938,470 A 7/1990 Antonious
5,048,835 A 9/1991 Gorman
5,121,922 A 6/1992 Harsh, Sr.
5,154,425 A * 10/1992 Niskanen ..... A63B 53/0466 473/342
5,184,823 A 2/1993 Desboilles
5,261,664 A 11/1993 Anderson
5,290,032 A 3/1994 Fenton
5,316,298 A 5/1994 Hutin
5,328,184 A 7/1994 Antonious
5,346,213 A 9/1994 Yamada
5,350,793 A * 9/1994 Kishimoto ..... C08K 7/00 524/495
5,398,929 A 3/1995 Kitaichi
5,403,007 A 4/1995 Chen
5,464,211 A 11/1995 Atkins, Sr.
5,492,327 A 2/1996 Biafore, Jr.
5,499,814 A 3/1996 Lu
5,505,453 A 4/1996 Mack
5,529,543 A 6/1996 Beaumont, Sr.
5,547,194 A 8/1996 Aizawa
5,547,427 A 8/1996 Riga
5,586,947 A 12/1996 Hutin
5,586,948 A 12/1996 Mick
5,588,923 A 12/1996 Schmidt
5,626,530 A 5/1997 Schmidt
5,628,697 A 5/1997 Gamble
5,669,829 A 9/1997 Lin
5,697,855 A 12/1997 Aizawa
5,766,092 A 6/1998 Mimeur
5,830,084 A 11/1998 Kosmatka
5,833,551 A 11/1998 Vincent
5,888,148 A 3/1999 Allen
5,890,973 A 4/1999 Gamble
5,899,821 A 5/1999 Hsu
5,971,868 A 10/1999 Kosmatka
6,001,030 A 12/1999 Delaney
6,015,354 A 1/2000 Ahn
6,030,294 A * 2/2000 Shira ..... A63B 53/047 473/349
6,042,486 A 3/2000 Gallagher
6,162,133 A 12/2000 Peterson
6,165,081 A 12/2000 Chou
D444,195 S 6/2001 Wahl
6,299,547 B1 10/2001 Kosmatka
6,299,549 B1 10/2001 Shieh
6,306,048 B1 10/2001 McCabe
6,309,311 B1 10/2001 Lu
6,364,789 B1 4/2002 Kosmatka
6,508,722 B1 1/2003 McCabe
6,595,870 B2 7/2003 Stites
6,695,715 B1 2/2004 Chikaraishi
D489,106 S 4/2004 Wahl
6,719,641 B2 4/2004 Dabbs
6,832,961 B2 12/2004 Sano
6,835,144 B2 12/2004 Best
6,855,066 B2 2/2005 Best
6,887,164 B2 5/2005 Danwanjee
6,902,495 B2 6/2005 Pergande
6,921,344 B2 7/2005 Gilbert
6,964,620 B2 11/2005 Gilbert
6,976,924 B2 12/2005 Gilbert
6,991,559 B2 1/2006 Yabu
7,008,331 B2 3/2006 Chen
7,056,229 B2 6/2006 Chen
7,096,558 B2 8/2006 Sano
7,140,977 B2 11/2006 Atkins, Sr.
7,160,204 B2 1/2007 Huang
7,211,006 B2 5/2007 Chang
7,214,144 B2 * 5/2007 Tseng ..... A63B 60/54 473/345
7,247,104 B2 7/2007 Poynor
7,371,190 B2 5/2008 Gilbert
7,387,579 B2 6/2008 Lin
7,476,162 B2 1/2009 Stites
7,559,853 B2 7/2009 Hirano
7,575,523 B2 8/2009 Yokota
7,578,755 B2 8/2009 Oyama
7,582,024 B2 9/2009 Shear
7,588,503 B2 9/2009 Roach
7,591,735 B2 9/2009 Matsunaga
7,597,633 B2 10/2009 Shimazaki
7,604,550 B1 10/2009 Currie
7,686,706 B2 3/2010 Matsunaga
7,713,141 B2 5/2010 Yamamoto
7,731,604 B2 6/2010 Wahl
7,749,100 B2 7/2010 Tavares
7,753,806 B2 7/2010 Beach
7,785,212 B2 8/2010 Lukasiewicz, Jr.
7,798,913 B2 9/2010 Noble
7,871,338 B2 1/2011 Nakano
7,878,920 B2 2/2011 Clausen
7,892,106 B2 2/2011 Matsunaga
7,935,000 B2 5/2011 Stites
7,967,700 B2 6/2011 Stites
8,088,025 B2 1/2012 Wahl
8,157,673 B2 4/2012 Gilbert
8,187,116 B2 5/2012 Boyd
8,210,961 B2 7/2012 Finn
8,210,965 B2 7/2012 Roach
8,267,807 B2 9/2012 Takechi
8,277,337 B2 10/2012 Shimazaki
8,328,663 B2 12/2012 Wahl
8,333,667 B2 12/2012 Kumamoto
8,348,782 B2 1/2013 Park
8,353,784 B2 1/2013 Boyd
8,403,771 B1 3/2013 Rice
8,403,774 B2 3/2013 Stites
8,517,863 B2 8/2013 Wahl
8,535,176 B2 9/2013 Bazzel
8,562,652 B2 10/2013 Biedermann
8,608,585 B2 12/2013 Stites
8,696,489 B2 4/2014 Gibbs
8,753,219 B2 6/2014 Gilbert
8,753,228 B2 6/2014 Golden
8,758,159 B2 6/2014 Morin
8,814,725 B2 8/2014 Wahl
8,821,307 B2 9/2014 Park
8,864,603 B2 10/2014 Kumamoto
8,920,261 B2 12/2014 Taylor et al.
8,961,336 B1 2/2015 Parsons et al.
9,011,266 B2 4/2015 Brunski
9,039,543 B2 5/2015 Mizutani
9,101,809 B2 8/2015 Gibbs
9,265,995 B2 2/2016 Wahl
9,457,241 B2 10/2016 Hebreo
9,545,548 B2 * 1/2017 Petersen ..... A63B 53/04
9,597,562 B2 3/2017 Dipert
9,662,549 B2 5/2017 Vrska, Jr.
9,849,354 B2 12/2017 Stokke
9,993,699 B2 6/2018 Larson
9,993,704 B2 6/2018 Hebreo
10,039,965 B1 8/2018 Seluga
10,086,244 B2 10/2018 Morin
10,150,019 B2 12/2018 Ines
10,220,272 B2 3/2019 Gonzalez
10,293,226 B2 5/2019 Hebreo
10,471,319 B1 11/2019 Mata
10,625,127 B2 4/2020 Golden
10,821,338 B2 11/2020 Hebreo
10,821,344 B2 11/2020 Mata
11,020,639 B2 6/2021 Golden
11,090,532 B2 8/2021 Wahl
11,090,534 B2 8/2021 Westrum
2003/0092502 A1 5/2003 Pergande
2003/0190975 A1 10/2003 Fagot
2004/0092329 A1 * 5/2004 Meyer ..... A63B 60/54 473/319
2005/0009624 A1 1/2005 Long
2005/0107183 A1 5/2005 Takeda

(56) References Cited

U.S. PATENT DOCUMENTS

| | | | | |
|---|---|---|---|---|
| 2005/0202181 | A1* | 9/2005 | Grossmann | B05B 7/1495 118/313 |
| 2005/0277485 | A1 | 12/2005 | Hou | |
| 2007/0026961 | A1 | 2/2007 | Hou | |
| 2007/0135233 | A1 | 7/2007 | Perras | |
| 2008/0004131 | A1 | 1/2008 | Lin | |
| 2008/0305888 | A1 | 12/2008 | Tseng | |
| 2009/0163295 | A1 | 6/2009 | Tseng | |
| 2009/0247314 | A1 | 10/2009 | Matsunaga | |
| 2010/0056296 | A1 | 3/2010 | Kumamoto | |
| 2010/0056297 | A1 | 3/2010 | Roach | |
| 2010/0273565 | A1 | 10/2010 | Stites | |
| 2011/0124432 | A1 | 5/2011 | Oldknow | |
| 2011/0159981 | A1 | 6/2011 | Bazzel | |
| 2011/0250985 | A1 | 10/2011 | Stites | |
| 2012/0064997 | A1 | 3/2012 | Sato | |
| 2012/0172144 | A1 | 7/2012 | Mazutani | |
| 2013/0130827 | A1 | 5/2013 | Boyd | |
| 2013/0324297 | A1 | 12/2013 | Larson | |
| 2015/0165280 | A1 | 6/2015 | Hebreo | |
| 2015/0343281 | A1 | 12/2015 | Ban | |
| 2017/0144037 | A1 | 5/2017 | Dipert | |
| 2017/0333765 | A1 | 11/2017 | Parsons | |
| 2018/0028882 | A1 | 2/2018 | Hebreo | |
| 2018/0028883 | A1 | 2/2018 | Morin | |
| 2018/0133565 | A1 | 5/2018 | Hebreo | |
| 2019/0151722 | A1 | 5/2019 | Gonzalez | |
| 2021/0046363 | A1 | 2/2021 | Golden | |
| 2021/0106887 | A1 | 4/2021 | Gonzalez | |
| 2021/0121748 | A1 | 4/2021 | Ines | |
| 2021/0236887 | A1 | 8/2021 | Demkowski | |

FOREIGN PATENT DOCUMENTS

| | | | |
|---|---|---|---|
| JP | 2001-170222 | | 6/2001 |
| JP | 2003284794 | A | 10/2003 |
| JP | 2006-000139 | A | 1/2006 |
| JP | 2007-21171 | | 1/2007 |
| JP | 2009-61317 | | 3/2009 |
| JP | 2009240365 | A | 10/2009 |
| JP | 2015-517882 | | 6/2015 |
| WO | WO2021/105129 | A1 * | 3/2021 |

* cited by examiner

GOLF CLUB DAMPING

TECHNICAL FIELD

This present technology generally relates to systems, devices, and methods related to golf clubs, and more specifically to iron type golf clubs.

DESCRIPTION OF THE RELATED TECHNOLOGY

The game of golf often involves the usage of a vast variety of different equipment. Generally speaking, a golfer may have several different types of clubs differing in three major categories; woods, irons, and a putter. Although different golfers may differ on what their favorite type of golf club in the bag may be, most all of them will say that their iron type golf clubs play a crucial part in their golf game.

All three types of clubs have utilized multi-material weighting to manipulate center of gravity locations as well as moments of inertia of the golf club heads. U.S. Pat. No. 6,306,048 is an illustration of the use of tungsten powder as weighting material. Additionally, U.S. Pat. No. 9,011,266 is an illustration of a filling material which "may comprise any of a foam, a polymeric material, a metal, a gel, a visco-elastic material, or any combination thereof." Additionally, use of tungsten powder within a polymer in a golf club head has been known.

Within the iron type category, the types of golf clubs are generally separated into two major categories, a muscle back type iron and a cavity back type iron. A muscle back type iron may generally be defined as a golf club formed from a unitary piece of metal that has a portion of increased thickness called a "muscle portion". Muscle back type irons have been existence since the early days of golf, and U.S. Pat. No. 2,007,377 to Link is an illustration of an early design of a muscle back iron. A cavity back iron, on the other hand, may generally refer to a golf club that creates an opening near the back portion of the golf club head. Although cavity type irons may generally have an open cavity that is exposed like shown in U.S. Pat. No. 4,826,172 to Antonious, the cavity back iron may also include a closed opening construction that creates an enclosed volume as shown in U.S. Pat. No. 5,766,092 to Mimeur et al.

The invention of cavity back irons provides significant performance advantages compared to the traditional muscle back irons. First and foremost, by removing weight from the back portion of the golf club, cavity back irons may generally be able to increase the moment of inertia of the golf club head by placing weight near the perimeter extremities of the golf club head. In addition to increasing the moment of inertia, cavity back irons can further improve the performance of the iron type golf club head by increasing the golf ball travel distance of the iron type golf club head. In general, golf clubs can achieve more distance by increasing the coefficient of restitution of the striking face, which cavity back irons can achieve by thinning out the striking face.

Focusing our discussion further on the cavity back irons, as discussed above that in order to improve the performance of these types of irons, golf club designers often try to create an extremely thin face to allow for more deflection of the face during impact with a golf ball. The increased deflection of the face during impact with a golf ball will generally allow the golf ball to travel further than a thicker face counterpart, thereby increasing the performance of the cavity back iron type golf club. U.S. Pat. No. 7,008,331 to Chen illustrates one of the earlier examples of experimenting with a thin face iron to increase the performance of an iron type golf club head.

However, cavity back irons with thin faces tend to be quite loud, as the resonance of the golf club head when striking a golf ball creates more sound power than many golfers prefer.

SUMMARY

The systems, methods, and devices described herein have innovative aspects, no single one of which is indispensable or solely responsible for their desirable attributes. Without limiting the scope of the claims, some of the advantageous features will now be summarized.

One aspect of the present technology is the realization that thinner and more flexible golf club head faces tend to create a louder sound when they strike a golf ball, which may not be the preference of some golfers. It is preferable for an iron type golf club head to produce a pleasant sound to the golfer when the golf club head strikes the golf ball. The present technology provides a novel solution to loud iron type golf club heads with thin striking faces by reducing the sound power produced by the golf club head when striking a golf ball by attenuating some of that sound.

One non-limiting embodiment of the present technology includes a golf club head including a striking face including a top, a bottom, a heel side, and a toe side; a hosel located at the heel side of the striking face; wherein the toe side is opposite the heel side; a sole extending rearwards from the bottom of the striking face; a topline extending rearwards from the top of the striking face; wherein the striking face comprises a front surface configured to strike a golf ball and a rear surface opposite the front surface; a damping element abutting the rear surface of the striking face; wherein the damping element covers a majority of the rear surface of the striking face; wherein the damping element comprises a binder and a filler; wherein the binder comprises a polymer; wherein the filler comprises a metal; wherein the filler has a density less than or equal to 2 g/cc and the binder has a density greater than or equal to 3 g/cc and less than or equal to 12 g/cc; wherein a ratio of the density of the filler divided by the density of the binder is greater than or equal to 3; wherein the filler is substantially evenly distributed throughout the binder; wherein the filler comprises a plurality of particles, wherein the particles of the filler are less than 5.0 mm in diameter; wherein the binder has a mass, wherein the filler has a mass, wherein a ratio of the mass of the binder divided by the mass of the filler is greater than or equal to 4 and less than or equal to 20; wherein the damping element comprises an average thickness, wherein the average thickness of the damping element is greater than or equal to 5 μm and less than or equal to 100 μm; and wherein the damping element comprises a mass, wherein the mass of the damping element is greater than or equal to 50 mg and less than or equal to 1000 mg.

An additional non-limiting embodiment of the present technology includes a golf club head including a striking face including a front surface configured to strike a golf ball and a rear surface opposite the front surface; a damping element abutting the rear surface of the striking face; wherein the damping element covers a majority of the rear surface of the striking face; wherein the damping element comprises a binder and a filler; wherein the filler has a density less than or equal to 2 g/cc and the binder has a density greater than or equal to 3 g/cc and less than or equal to 12 g/cc; wherein the filler is substantially evenly distributed throughout the binder; wherein the filler comprises a plurality of particles, wherein the particles of the filler are less than 5.0 mm in diameter; and wherein the damping element comprises an average thickness, wherein the average thickness of the damping element is greater than or equal to 5 μm and less than or equal to 100 μm.

In an additional non-limiting embodiment of the present technology the binder comprises a polymer and wherein the filler comprises a metal.

In an additional non-limiting embodiment of the present technology the binder has a density greater than or equal to 5 g/cc and less than or equal to 10 g/cc.

In an additional non-limiting embodiment of the present technology the binder has a density greater than or equal to 7 g/cc.

In an additional non-limiting embodiment of the present technology a ratio of the density of the filler divided by the density of the binder is greater than or equal to 3.

In an additional non-limiting embodiment of the present technology a ratio of the density of the filler divided by the density of the binder is greater than or equal to 5.

In an additional non-limiting embodiment of the present technology the particles of the filler are less than 1.0 mm in diameter.

In an additional non-limiting embodiment of the present technology the binder has a mass, wherein the filler has a mass, wherein a ratio of the mass of the binder divided by the mass of the filler is greater than or equal to 4 and less than or equal to 20.

In an additional non-limiting embodiment of the present technology the damping element comprises a mass, wherein the mass of the damping element is greater than or equal to 50 mg and less than or equal to 1000 mg.

An additional non-limiting embodiment of the present technology includes a golf club head including a striking face including a front surface configured to strike a golf ball and a rear surface opposite the front surface; a damping element abutting the rear surface of the striking face; wherein the damping element comprises a binder and a filler; wherein the binder comprises a polymer; wherein the filler comprises a metal; wherein the filler has a density less than or equal to 2 g/cc and the binder has a density greater than or equal to 3 g/cc and less than or equal to 12 g/cc; wherein a ratio of the density of the filler divided by the density of the binder is greater than or equal to 3; wherein the filler is substantially evenly distributed throughout the binder; and wherein the binder has a mass, wherein the filler has a mass, wherein a ratio of the mass of the binder divided by the mass of the filler is greater than or equal to 4 and less than or equal to 20.

In an additional non-limiting embodiment of the present technology the damping element covers a majority of the rear surface of the striking face.

In an additional non-limiting embodiment of the present technology the filler has a density less than or equal to 2 g/cc and the binder has a density greater than or equal to 5 g/cc and less than or equal to 10 g/cc.

In an additional non-limiting embodiment of the present technology the filler has a density less than or equal to 2 g/cc and the binder has a density greater than or equal to 7 g/cc.

In an additional non-limiting embodiment of the present technology a ratio of the density of the filler divided by the density of the binder is greater than or equal to 5.

In an additional non-limiting embodiment of the present technology the filler comprises a plurality of particles, wherein the particles of the filler are less than 5.0 mm in diameter.

In an additional non-limiting embodiment of the present technology the filler comprises a plurality of particles, wherein the particles of the filler are less than 1.0 mm in diameter.

In an additional non-limiting embodiment of the present technology the damping element comprises an average thickness, wherein the average thickness of the damping element is greater than or equal to 5 μm and less than or equal to 100 μm.

In an additional non-limiting embodiment of the present technology the damping element comprises a mass, wherein the mass of the damping element is greater than or equal to 50 mg and less than or equal to 1000 mg.

In an additional non-limiting embodiment of the present technology the ratio of the mass of the binder divided by the mass of the filler is greater than or equal to 6 and less than or equal to 15.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

Figure 1:
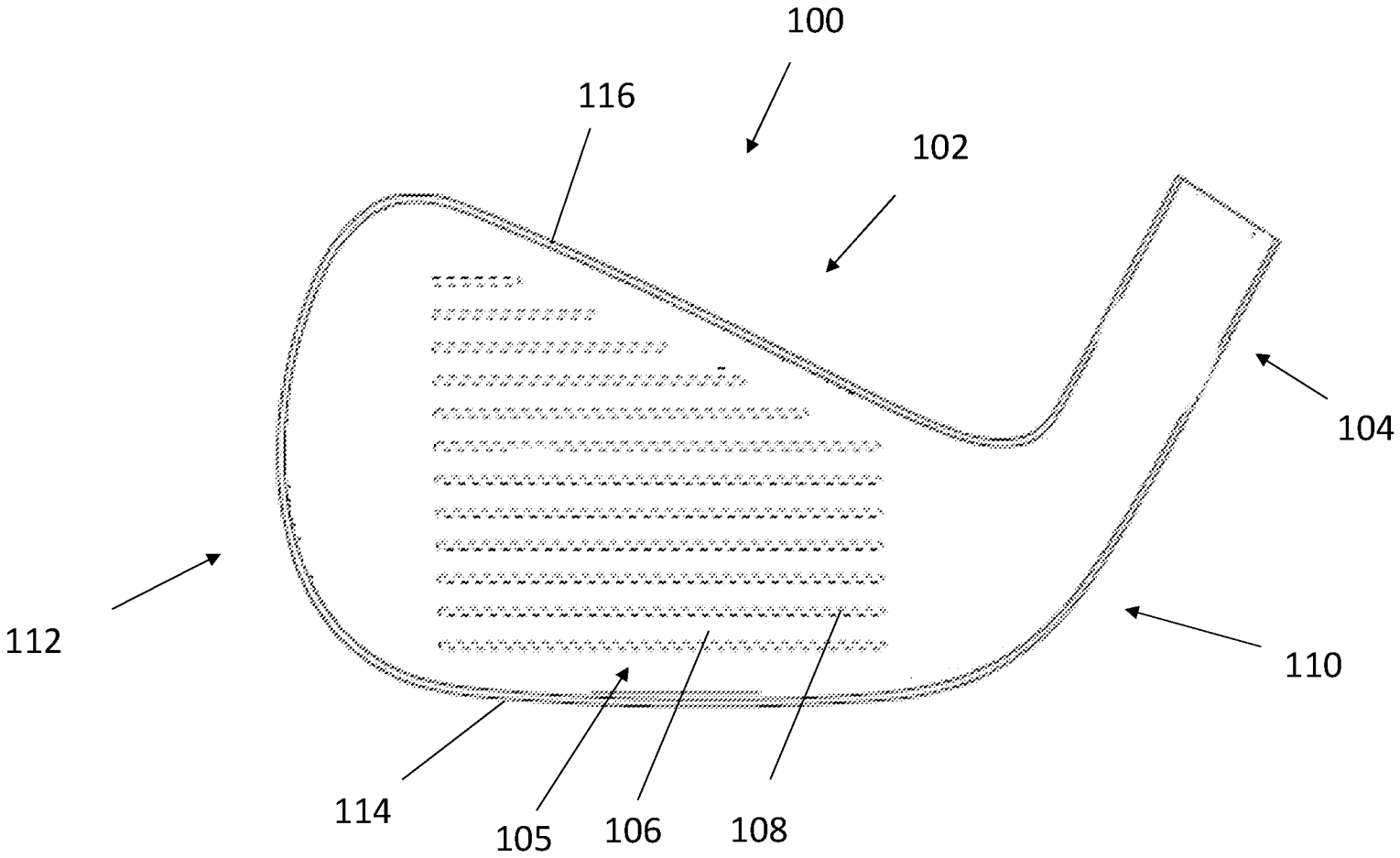
FIG. 1 depicts a front view of a golf club head.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Figure 2:
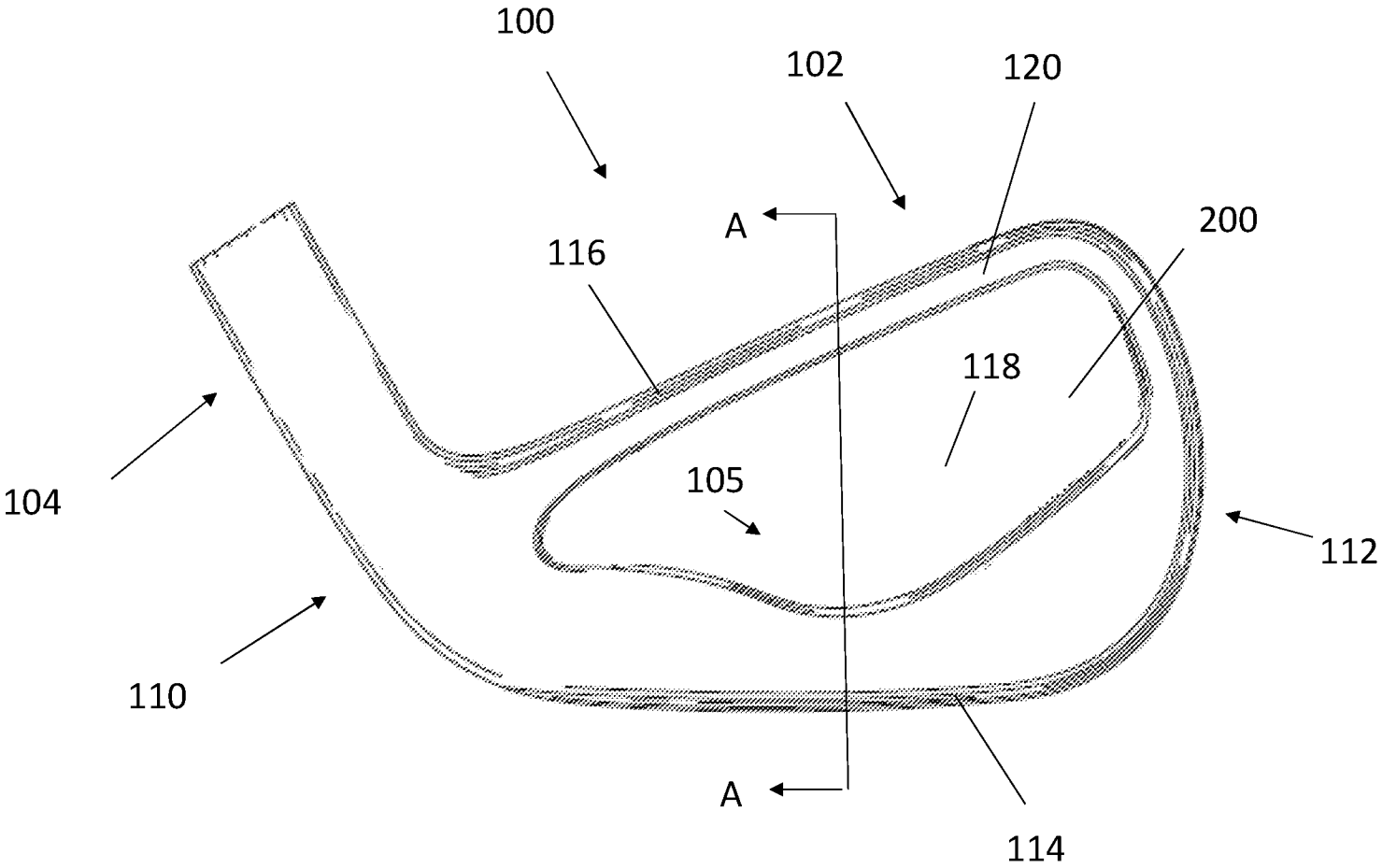
FIG. 2 depicts a rear view of the golf club head of FIG. 1.
Figure 4:
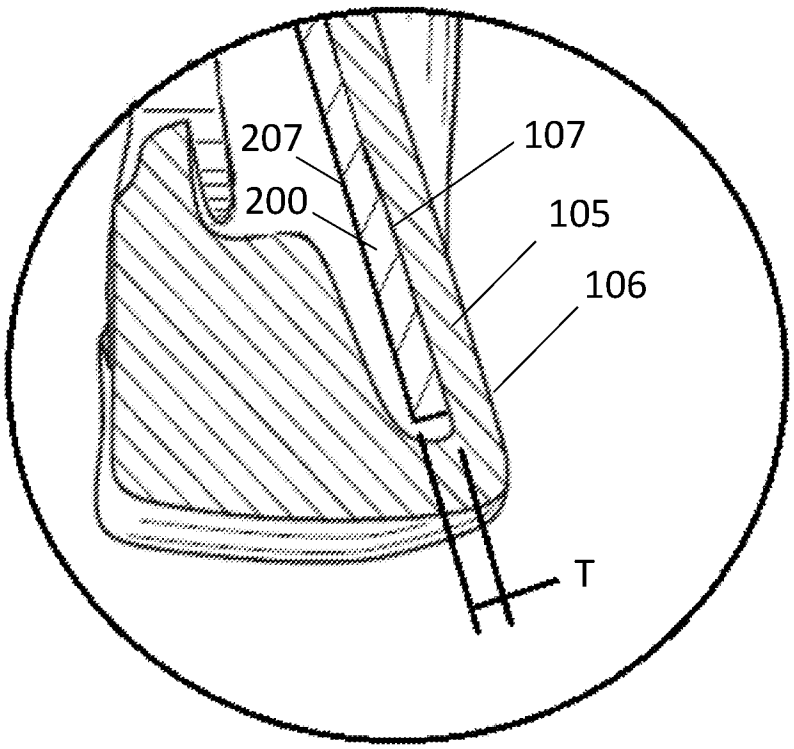
FIG. 4 illustrates a detail view of the lower half of the golf club head.
Figure 3:
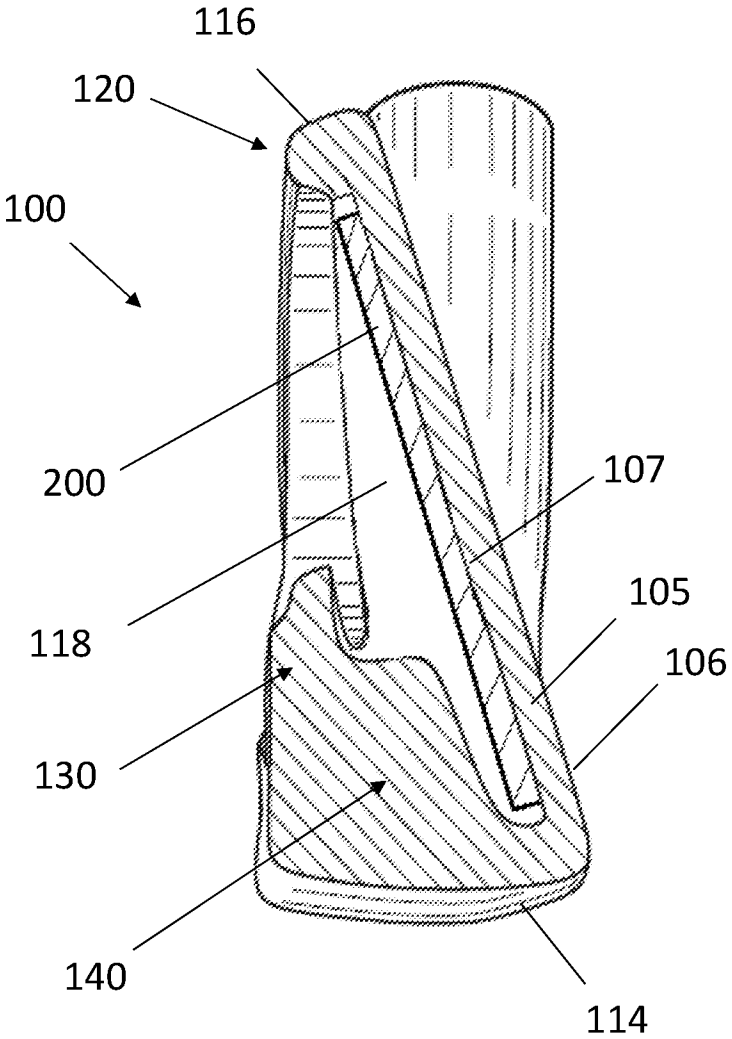
FIG. 3 depicts a cross-sectional view A-A of the golf club head of FIGS. 1 and 2.

The technologies described herein contemplate a golf club head, and more specifically, an iron-type golf club head that incorporates a damping element. FIGS. 1-4 illustrate an iron type cavity back golf club head. FIG. 1 depicts a front view of a golf club head 100. FIG. 2 depicts a rear view of the golf club head 100 of FIG. 1. FIG. 3 depicts a cross-sectional view A-A of the golf club head 100 of FIGS. 1 and 2. FIG. 4 illustrates a detail view of the lower half of the golf club head 100. The golf club head 100 is illustrated in an address position at prescribed loft and lie. Any references to location or portions of the golf club head 100 are made with the golf club head 100 in an address position. The golf club head 100 includes a coordinate system centered at a center of gravity of the golf club head, the coordinate system having a y-axis extending vertically, perpendicular to a ground plane when the golf club head is in an address position at prescribed loft and lie, an x-axis perpendicular to said y-axis and parallel to the striking face, extending towards a heel of said golf club head, and a z-axis, perpendicular to the y-axis and the x-axis and extending through the striking face.

As illustrated in FIGS. 1-4, the golf club head 100 is an iron type golf club head, and more specifically, a cavity back iron type golf club head. The golf club head 100 includes a hosel 104 affixed to the body 102. The body 102 includes a heel side 110 adjacent the hosel 104 and a toe side 112 opposite the heel side 110. The body includes a striking face 105 with a front surface 106 configured to strike a golf ball and a rear surface 107 opposite the front surface 106. The striking face 105 includes a plurality of scorelines 108 extending into the front surface 106 of the striking face 105. The body 102 includes a perimeter portion 120 extending back from the striking face 105 which includes a topline 116 located above the striking face 105 and a sole 114 located below the striking face 105. A cavity 118 is formed behind the striking face 105 and within the perimeter portion 120. The body 102 can also include a back portion 130 which partially encloses the cavity 118 as illustrated in FIGS. 1-3. The body 102 can also include one or more weight members 140 which could be an integrally formed mass pad as illustrated in FIG. 3, or a higher density weight member. In other embodiments, not illustrated, the back portion could fully enclose the cavity, forming an enclosed volume.

As described above, thin faced iron type golf club heads can create an acoustic signature that is not preferred by most golfers due to resonance of the golf club head, and more specifically, the striking face, when they impact a golf ball. Innovative methods and constructions will be discussed below to tailor the acoustic signature of golf club heads to be more pleasurable to the golfer. More specifically, the damping elements described herein significantly decrease the sound power created by the golf club head when impacting a golf ball.

As illustrated in FIGS. 2 and 3, a damping element 200 is affixed to the rear surface 107 of the striking face 105. In a preferred embodiment, as illustrated, the damping element 200 covers a majority of the rear surface 107 of the striking face 105, extending from the heel side 110 to the toe side 112 and from the sole 114 to the topline 116. In other embodiments, the damping element 200 may cover a smaller portion of the rear surface 107 of the striking face 105. In one embodiment, the golf club head may include more than one damping element 200. In one embodiment, the damping element may extend from the heel side 110 to the toe side 112 but only cover a portion of rear surface 107 of the striking face 105 adjacent the sole 114. In another embodiment, the damping element may cover a central portion of the rear surface 107 of the striking face 105. In another embodiment, the damping element may cover a portion of the rear surface 107 of the striking face 105 and the golf club head may include an additional damping member of a different construction.

In a preferred embodiment, the damping element 200 includes more than one material. More preferably, the damping element 200 includes a binder ingredient having a first density, and a filler ingredient having a second density, the second density being greater than the first density. In one embodiment, it is preferable for the filler to be substantially evenly distributed throughout the binder.

In one embodiment, the binder has a density of less than or equal to 2.0 g/cc. In one embodiment, the filler has a density of greater than or equal to 2.0 g/cc. In another embodiment, the filler has a density of greater than or equal to 3.0 g/cc. In another embodiment, the filler has a density of greater than or equal to 5.0 g/cc. In another embodiment, the filler has a density of greater than or equal to 7.0 g/cc. In another embodiment, the filler has a density of greater than or equal to 10.0 g/cc. In another embodiment, the filler has a density of greater than or equal to 12.0 g/cc. In another embodiment, the filler has a density of greater than or equal to 14.0 g/cc. In another embodiment, the filler has a density of greater than or equal to 3.0 g/cc and less than or equal to 12 g/cc. In another embodiment, the filler has a density of greater than or equal to 5.0 g/cc and less than or equal to 10 g/cc. In another embodiment, the filler has a density of greater than or equal to 7.0 g/cc and less than or equal to 12 g/cc. In one embodiment, the ratio of the density of the filler divided by the density of the binder is greater than or equal to 2. In another embodiment, the ratio of the density of the filler divided by the density of the binder is greater than or equal to 3. In another embodiment, the ratio of the density of the filler divided by the density of the binder is greater than or equal to 4. In another embodiment, the ratio of the density of the filler divided by the density of the binder is greater than or equal to 5. In another embodiment, the ratio of the density of the filler divided by the density of the binder is greater than or equal to 6. In another embodiment, the ratio of the density of the filler divided by the density of the binder is greater than or equal to 8.

In one embodiment, the damping element 200 is applied to the interior of the golf club head via spraying. In one embodiment, the damping element 200 can be sprayed in a single coat. In another embodiment, the damping element can be applied in a plurality of successive coats. The process can incorporate a set time in between the spraying of each coat. In other embodiments, coats can be applied successively without any significant set time in between each coat. In one embodiment, the damping element can be applied in two or more coats. In another embodiment the damping element can be applied in three or more coats. In another embodiment the damping element can be applied in four or more coats. Additionally, the golf club head can be heated to cure the damping element. Curing temperatures can range from 18° Celsius to 140° Celsius. In other embodiments, the damping element could be applied without spraying. In one embodiment, the damping element could be brushed on, in another it could be rolled on, in another it could be poured into the cavity of the golf club head. In yet another embodiment, the damping element could be formed separately and adhered to the interior of the golf club head.

As illustrated in FIG. 4, the damping element 200 has an average thickness T measured from the rear surface 107 of the striking face to the rear surface 207 of the damping element 200. In order to find the average thickness T, three thickness measurements should be taken, one from the toe-most portion of the damping element, one from the center of the damping element, and one from the heel-most portion of the damping element. In one embodiment the average thickness T of the damping element is greater than or equal to 2 μm and less than or equal to 100 μm. In another embodiment the average thickness T of the damping element is greater than or equal to 2 μm and less than or equal to 75 μm. In another embodiment the average thickness T of the damping element is greater than or equal to 2 μm and less than or equal to 50 μm. In another embodiment the average thickness T of the damping element is greater than or equal to 5 μm and less than or equal to 50 μm. In another embodiment the average thickness T of the damping element is greater than or equal to 10 μm and less than or equal to 50 μm. In another embodiment the average thickness T of the damping element is greater than or equal to 15 μm and less than or equal to 50 μm. In another embodiment the average thickness T of the damping element is greater than or equal to 5 μm and less than or equal to 40 μm. In another embodiment the average thickness T of the damping element is greater than or equal to 5 μm and less than or equal to 30 μm.

The damping element 200 has a mass which is dependent on both its composition and its size. The damping element 200 described herein is incredibly effective at reducing sound power while minimally increasing the mass of the golf club head, allowing for more discretionary mass in the clubhead to be utilized for optimizing other properties like moment of inertia. In one embodiment the damping element has a mass less than or equal to 1000 mg. In another embodiment the damping element has a mass less than or equal to 800 mg. In another embodiment the damping element has a mass less than or equal to 600 mg. In another embodiment the damping element has a mass less than or equal to 400 mg. In another embodiment the damping element has a mass less than or equal to 300 mg. In another embodiment the damping element has a mass less than or equal to 200 mg. In another embodiment the damping element has a mass greater than or equal to 50 mg and less than or equal to 1000 mg. In another embodiment the damping element has a mass greater than or equal to 50 mg and less than or equal to 800 mg. In another embodiment the damping element has a mass greater than or equal to 50 mg and less than or equal to 600 mg. In another embodiment the damping element has a mass greater than or equal to 100 mg and less than or equal to 400 mg.

As mentioned earlier the damping element can be multi-material, including a binder and a filler. In one embodiment, the binder does not comprise a metal material. In one embodiment, the binder includes a polymer. In other embodiments, the binder may include additional ingredients such as pigments, solvents, etc. In one embodiment, the binder is a paint. In other embodiments the binder can be, for example, rubber, resin, polyester, thermoplastic polyurethane, silicone, etc. In one embodiment the filler is a metal material. The filler material can be, for example, tungsten, aluminum, iron, steel, stainless steel, magnesium, manganese, nickel, copper, graphite, silver, brass, cobalt, calcium, potassium, etc. One filler which proved particularly effective in testing was Mn-20CU-5Ni-2Fe (atomic %).

It is preferable for the filler to have a small particle size for it to be substantially evenly distributed throughout the damping element and to offer optimal damping properties. The filler particles are preferably less than or equal to 5.0 mm in diameter, more preferably less than or equal to 1.0 mm in diameter, more preferably less than or equal to 0.5 mm in diameter, more preferably less than or equal to 0.3 mm in diameter, and most preferably less than or equal to 0.1 mm in diameter.

The damping element 200 has a mass ratio defined by the mass of the binder divided by the mass of the filler included in the damping element 200. In one embodiment, the mass ratio is less than or equal to 50 and grater than or equal to 1. In another embodiment, the mass ratio is less than or equal to 25 and greater than or equal to 2. In another embodiment, the mass ratio is less than or equal to 20 and greater than or equal to 4. In another embodiment, the mass ratio is less than or equal to 15 and greater than or equal to 6. In another embodiment, the mass ratio is less than or equal to 12 and greater than or equal to 8.

The damping element 200 described herein including a low density binder and high density filler offers superior sound attenuation due to its superior damping properties by rapidly dissipating vibrational energy and converting it into heat. 2019 generation Titleist T300 irons, minus medallions, were utilized to test the effectiveness of utilizing the multi-material damping element 200 described herein to reduce the sound power output produced when the golf club head impacts a golf ball. Testing was performed with Titleist ProV1 golf balls with a club head speed of approximately 95 miles per hour. The acoustic qualities of the clubs were recorded when each golf club head struck a golf ball.

Figure 5:
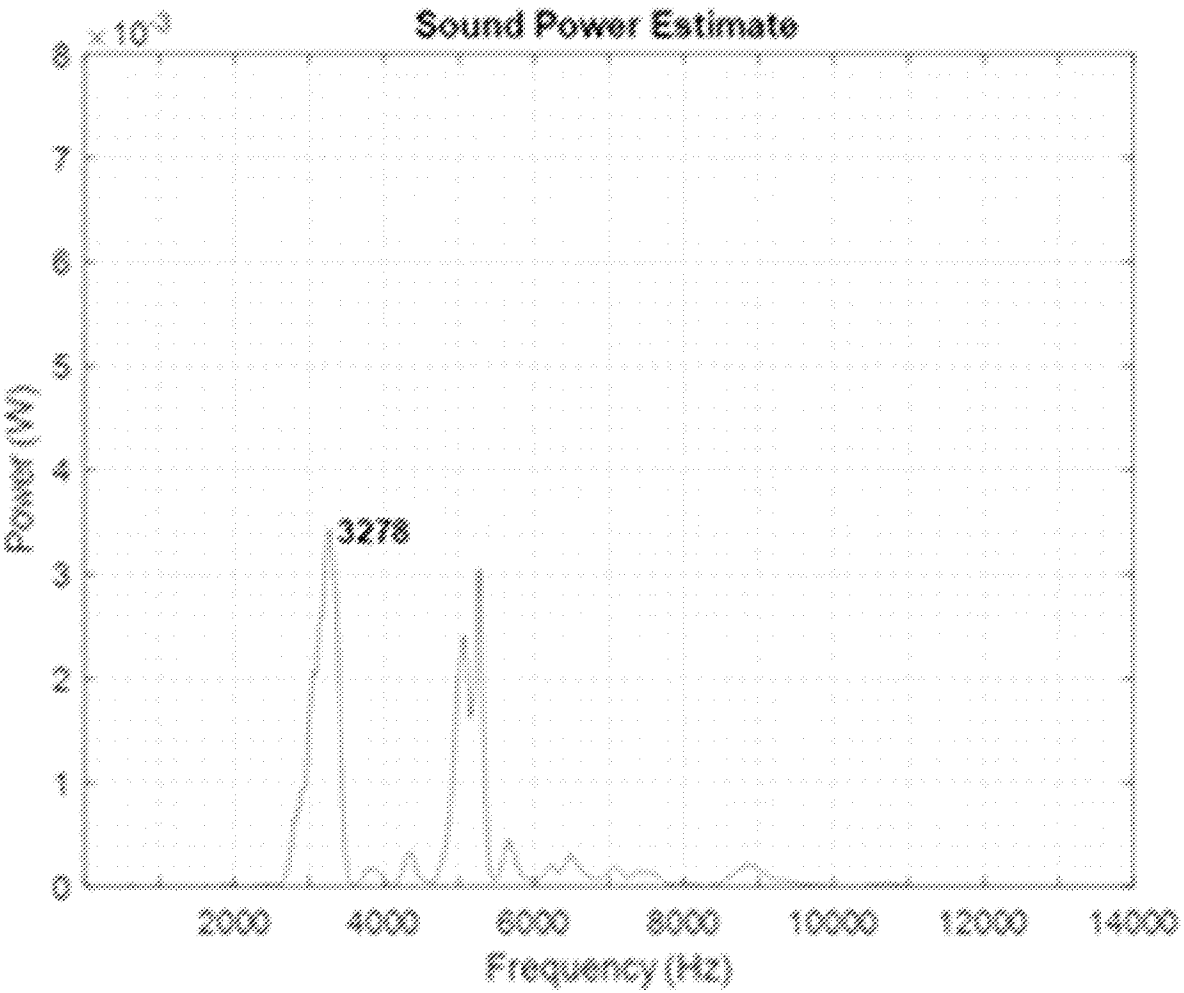
FIG. 5 illustrates the acoustic qualities of the T300 without the damping element illustrated in FIGS. 2-4.
Figure 6:
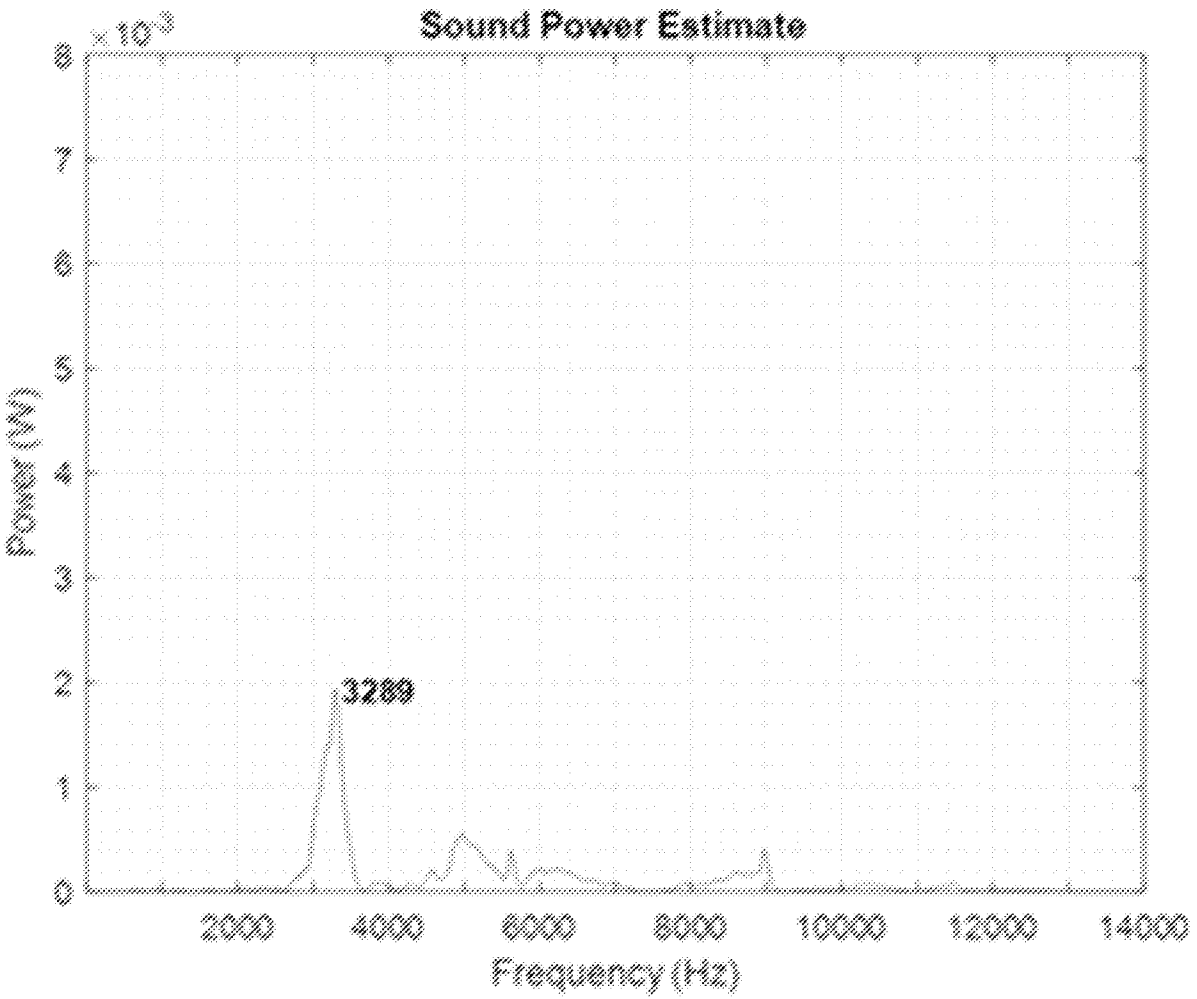
FIG. 6 illustrates the acoustic qualities of an identical T300, but with the damping element illustrated in FIGS. 2-4 added.

FIG. 5 illustrates the acoustic qualities of the T300 without the damping element illustrated in FIGS. 2-4. FIG. 6 illustrates the acoustic qualities of an identical T300, but with the damping element 200 illustrated in FIGS. 2-4 added. The damping element included a Mn-20CU-5Ni-2Fe filler material, with a density of 7.25 g/cc, mixed into a paint binder with a mass ratio of approximately 10. Three coats of the damping element was sprayed onto the rear surface of the striking face. The damping element covered a majority of the rear surface of the striking face and had an average thickness between approximately 10 and 20 μm.

By comparing FIGS. 5 and 6, one can conclude that the golf club head including the sprayed on multi-material damping element significantly reduced the sound power output when the golf club head struck a golf ball. Both clubs have an active vibrational mode at approximately 3,300 Hz which can be mostly attributable to the vibration of the striking face. The golf club head of FIG. 5 without the sprayed on multi-material damping element produced approximately $3.4\times10^{-3}$ watts of sound power at 3,300 Hz while the golf club head of FIG. 6 with the sprayed on multi-material damping element produced less than $2.0\times10^{-3}$ watts of sound power at 3,300 Hz. Additionally, the impact produced an additional vibrational mode at approximately 5,000 Hz reaching $3.0\times10^{-3}$ watts of sound power for the golf club head of FIG. 5 without the sprayed on multi-material damping element. The sound power produced at approximately 5,000 Hz was almost massively reduced in FIG. 6 of the golf club head with the sprayed on multi-material damping element, reaching only approximately $0.5\times10^{-3}$ watts of sound power.

Figure 7:
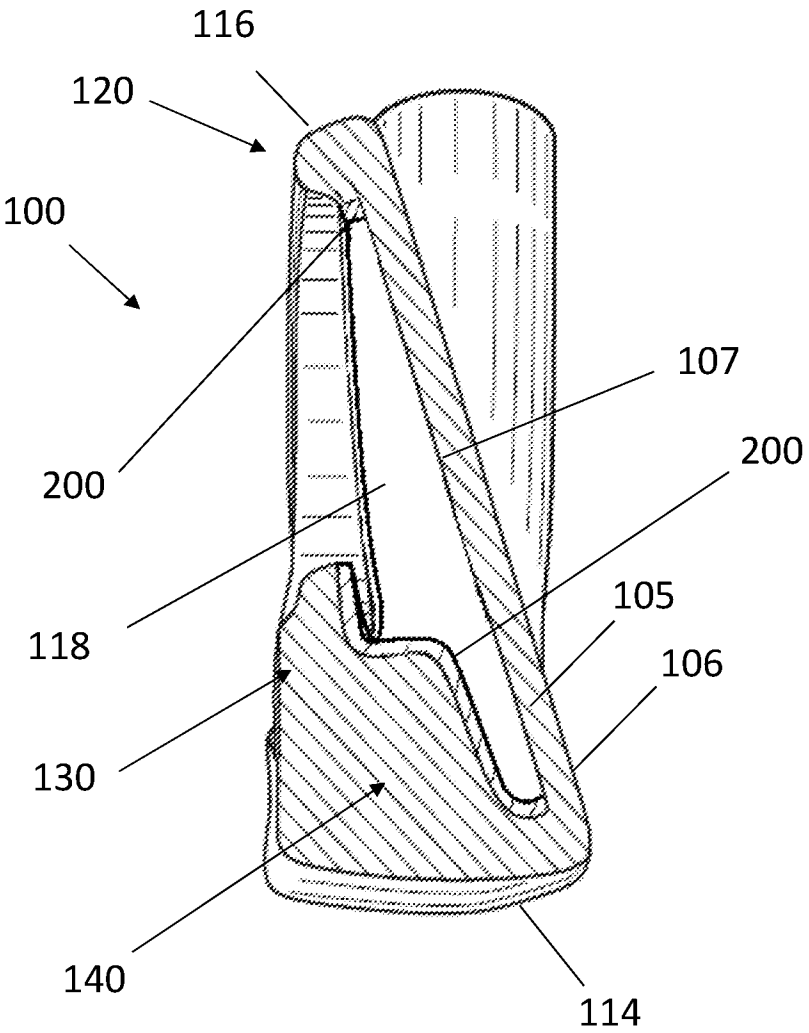
FIG. 7 FIG. 7 illustrates a cross-sectional view of the golf club head of FIGS. 1-4 including an alternative embodiment of the damping element.

FIG. 7 illustrates a cross-sectional view of the golf club 100 of FIGS. 1-4 including an alternative embodiment of the damping element 200. In additional embodiments, the damping element 200 could be applied to additional portions of the golf club head in addition or instead of the rear surface of the striking face. These additional portions could include, for example, the interior of the sole, the interior of the toe, the interior of the heel, the interior of the topline, and the interior of the back portion. FIG. 4 illustrates the damping element 200 applied to the interior of the topline 116, the interior of the sole 114, and the interior of the back portion 130. Additionally, in an additional embodiment, the golf club head 100 could also include a medallion, no illustrated, and a damping element could be applied to the internal surface of the medallion facing the internal cavity 118.

Figure 8:
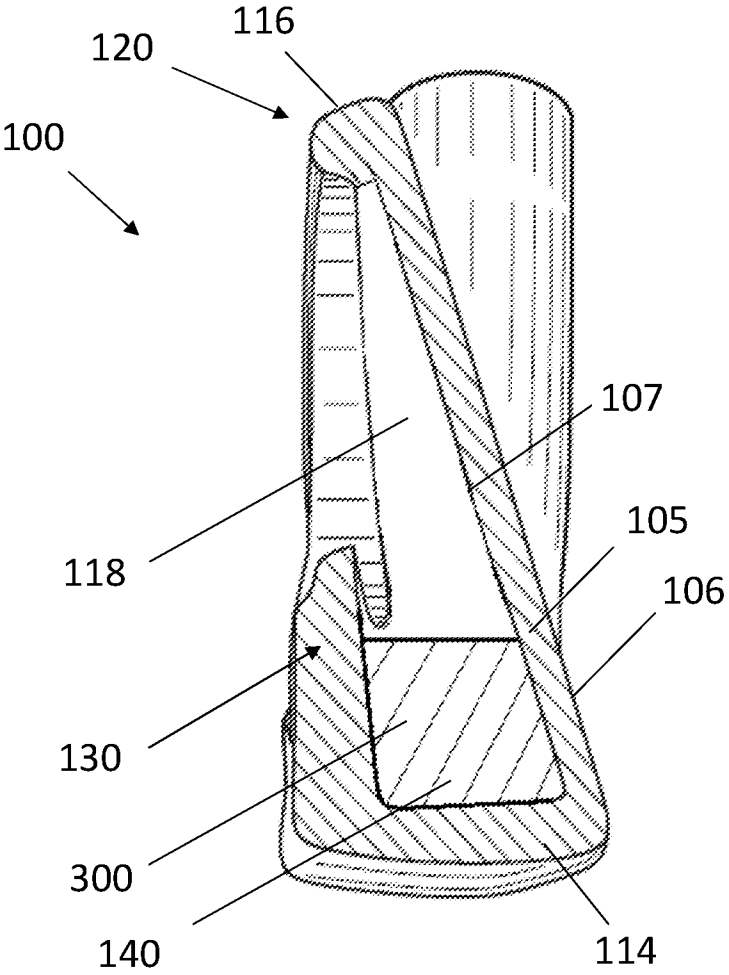
FIG. 8 illustrates a cross-sectional view of an alternative embodiment of the golf club head and damping element of FIGS. 1-4.

FIG. 8 illustrates a cross-sectional view of an additional alternative embodiment of the golf club head 100 and damping element of FIGS. 1-4. In this embodiment the damping element 300 has is thicker than the embodiments discussed above. By increasing the size of the damping element 300 it can also be utilized as a weight member 140. By incorporating a large enough amount of high density filler material in the damping element, the damping element can have a density which is higher than the material forming the rest of the golf club head, and can be utilized to optimize the center of gravity location, optimizing ball speed and trajectory, and increase the moment of inertia of the golf club head, making the golf club easier to use for golfer's who don't always hit the golf ball with the optimal location on the striking face. In one embodiment, the damping element 300 can have a density greater than or equal to 8.0 g/cc. In another embodiment, the damping element 300 can have a density greater than or equal to 10.0 g/cc. In another embodiment, the damping element 300 can have a density greater than or equal to 12.0 g/cc.

In one embodiment, the damping element 300 extends from the heel side 110 to the toe side 112 along the sole 114 and abuts the rear surface 107 of the striking face 105 as well as the back portion 130. In another embodiment, there may be two or more damping elements 300, preferably with one damping element 300 located adjacent the toe side 112 and one damping element 300 located adjacent the heel side 110. This embodiment of damping element 300 also contacts the rear surface 107 of the striking face 105 and offers benefits in damping vibration and decreasing sound power emitted by the golf club when it impacts a golf ball.

Finally, while not illustrated herein, the damping elements 200, 300 that were described herein can also be utilized in metalwood golf club heads. The damping elements 200, 300 could abut various portions of the metalwood golf club head, which may include, for example, the striking face, the sole, the crown, the skirt, etc. The damping elements 200, 300 can also be utilized in putters.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

The invention claimed is:

1. A golf club head comprising:
a striking face comprising a top, a bottom, a heel side, and a toe side;
a hosel located at said heel side of said striking face;
wherein said toe side is opposite said heel side;
a sole extending rearwards from said bottom of said striking face;
a topline extending rearwards from said top of said striking face;
wherein said striking face comprises a front surface configured to strike a golf ball and a rear surface opposite said front surface;
a damping element abutting said rear surface of said striking face;
wherein said damping element covers a majority of said rear surface of said striking face;
wherein said damping element comprises a binder and a filler;
wherein said binder comprises a polymer;
wherein said filler comprises a metal;
wherein said binder has a density less than or equal to 2 g/cc and said filler has a density greater than or equal to 3 g/cc and less than or equal to 12 g/cc;
wherein a ratio of said density of said filler divided by said density of said binder is greater than or equal to 3;
wherein said filler is substantially evenly distributed throughout said binder;
wherein said filler comprises a plurality of particles, wherein said plurality of particles of said filler are less than 5.0 mm in diameter;
wherein said binder has a mass, wherein said filler has a mass, wherein a ratio of said mass of said binder divided by said mass of said filler is greater than or equal to 4 and less than or equal to 20;
wherein said damping element comprises an average thickness, wherein said average thickness of said damping element is greater than or equal to 5 μm and less than or equal to 100 μm; and
wherein said damping element comprises a mass, wherein said mass of said damping element is greater than or equal to 50 mg and less than or equal to 1000 mg.

2. A golf club head comprising:
a striking face comprising a front surface configured to strike a golf ball and a rear surface opposite said front surface;
a damping element abutting said rear surface of said striking face;
wherein said damping element covers a majority of said rear surface of said striking face;
wherein said damping element comprises a binder and a filler;
wherein said binder has a density less than or equal to 2 g/cc and said filler has a density greater than or equal to 3 g/cc and less than or equal to 12 g/cc;
wherein said filler is substantially evenly distributed throughout said binder;
wherein said filler comprises a plurality of particles, wherein said plurality of particles of said filler are less than 5.0 mm in diameter; and
wherein said damping element comprises an average thickness, wherein said average thickness of said damping element is greater than or equal to 5 μm and less than or equal to 100 μm.

3. The golf club head of claim 2, wherein said binder comprises a polymer and wherein said filler comprises a metal.

4. The golf club head of claim 2, wherein said filler has a density greater than or equal to 5 g/cc and less than or equal to 10 g/cc.

5. The golf club head of claim 2, wherein said filler has a density greater than or equal to 7 g/cc.

6. The golf club head of claim 2, wherein a ratio of said density of said filler divided by said density of said binder is greater than or equal to 3.

7. The golf club head of claim 2, wherein a ratio of said density of said filler divided by said density of said binder is greater than or equal to 5.

8. The golf club head of claim 2, wherein said plurality of particles of said filler are less than 1.0 mm in diameter.

9. The golf club head of claim 2, wherein said binder has a mass, wherein said filler has a mass, wherein a ratio of said mass of said binder divided by said mass of said filler is greater than or equal to 4 and less than or equal to 20.

10. The golf club head of claim 2, wherein said damping element comprises a mass, wherein said mass of said damping element is greater than or equal to 50 mg and less than or equal to 1000 mg.

11. A golf club head comprising:
a striking face comprising a front surface configured to strike a golf ball and a rear surface opposite said front surface;
a damping element abutting said rear surface of said striking face;
wherein said damping element comprises a binder and a filler;
wherein said binder comprises a polymer;
wherein said filler comprises a metal;
wherein said binder has a density less than or equal to 2 g/cc and said filler has a density greater than or equal to 3 g/cc and less than or equal to 12 g/cc;
wherein a ratio of said density of said filler divided by said density of said binder is greater than or equal to 3;
wherein said filler is substantially evenly distributed throughout said binder; and
wherein said binder has a mass, wherein said filler has a mass, wherein a ratio of said mass of said binder divided by said mass of said filler is greater than or equal to 4 and less than or equal to 20.

12. The golf club head of claim 11, wherein said damping element covers a majority of said rear surface of said striking face.

13. The golf club head of claim 11, wherein said binder has a density less than or equal to 2 g/cc and said filler has a density greater than or equal to 5 g/cc and less than or equal to 10 g/cc.

14. The golf club head of claim 11, wherein said binder has a density less than or equal to 2 g/cc and said filler has a density greater than or equal to 7 g/cc.

15. The golf club head of claim 11, wherein a ratio of said density of said filler divided by said density of said binder is greater than or equal to 5.

16. The golf club head of claim 11, wherein said filler comprises a plurality of particles, wherein said plurality of particles of said filler are less than 5.0 mm in diameter.

17. The golf club head of claim 11, wherein said filler comprises a plurality of particles, wherein said plurality of particles of said filler are less than 1.0 mm in diameter.

18. The golf club head of claim 11, wherein said damping element comprises an average thickness, wherein said average thickness of said damping element is greater than or equal to 5 μm and less than or equal to 100 μm.

19. The golf club head of claim 11, wherein said damping element comprises a mass, wherein said mass of said damping element is greater than or equal to 50 mg and less than or equal to 1000 mg.

20. The golf club head of claim 11, wherein said ratio of said mass of said binder divided by said mass of said filler is greater than or equal to 6 and less than or equal to 15.

* * * * *